US008678620B1

(12) United States Patent
Barenboim

(10) Patent No.: US 8,678,620 B1
(45) Date of Patent: Mar. 25, 2014

(54) PROTECTIVE DOME

(75) Inventor: James Barenboim, Andover, MA (US)

(73) Assignee: Packaging Partners, LLC, Lawrence, MA (US)

( * ) Notice: Subject to any disclaimer, the term of this patent is extended or adjusted under 35 U.S.C. 154(b) by 86 days.

(21) Appl. No.: 13/455,571

(22) Filed: Apr. 25, 2012

Related U.S. Application Data

(60) Provisional application No. 61/479,091, filed on Apr. 26, 2011.

(51) Int. Cl.
*F21V 3/00* (2006.01)

(52) U.S. Cl.
USPC ..... 362/311.01; 362/444

(58) Field of Classification Search
USPC ..... 248/231.61; 362/311.01, 444, 457, 356
See application file for complete search history.

(56) References Cited

U.S. PATENT DOCUMENTS

| | | | | | |
|---|---|---|---|---|---|
| 4,063,079 | A | * | 12/1977 | Feder | 362/290 |
| 5,601,355 | A | | 2/1997 | Valentino | |
| 5,611,618 | A | | 3/1997 | Sawyer | |
| 5,613,772 | A | | 3/1997 | Sawyer | |
| 5,758,850 | A | * | 6/1998 | Yousefzadeh | 248/231.61 |
| 5,857,652 | A | * | 1/1999 | Yousefzadeh | 248/231.61 |
| 6,227,680 | B1 | | 5/2001 | Arndt | |
| 7,410,277 | B1 | | 8/2008 | Leddusire | |
| 7,819,374 | B2 | | 10/2010 | Pitlor | |
| 2003/0147243 | A1 | * | 8/2003 | Alduby | 362/311 |

* cited by examiner

*Primary Examiner* — Anne Hines
(74) *Attorney, Agent, or Firm* — David M. Driscoll, Esq.

(57) ABSTRACT

A dome structure for protecting a finial on a lamp structure. The dome structure includes a centrally disposed plastic dome with integrally formed legs extending in opposed directions from the dome. The dome forms an enclosing chamber that fits over the finial to prevent theft of the finial. The legs have respective interlocking elements that engage with the lamp structure. Another embodiment uses wire ties to secure the dome.

20 Claims, 4 Drawing Sheets

PROTECTIVE DOME

RELATED CASE

Priority for this application is hereby claimed under 35 U.S.C. §119(e) to commonly owned and U.S. Provisional Patent Application No. 61/479,091 which was filed on Apr. 26, 2011 and which is incorporated by reference herein in its entirety.

FIELD OF THE INVENTION

The present invention relates in general to a protective member that is meant to be placed over a lamp finial so as to prevent the theft of the finial.

BACKGROUND OF THE INVENTION

At the present time in lighting establishments, the lamp shades on a lamp are held in place by a finial. However, it has been found that shoppers can too easily remove the finial and thus make the entire lamp product unsellable, or time and effort have to be devoted to replace the finial before the lamp can be sold.

Accordingly, it is an object of the present invention to provide a protective dome structure that is meant to be secured about the finial for the purpose of preventing theft of the finial.

SUMMARY OF THE INVENTION

In accordance with the present invention, there is provided a dome structure that is preferably constructed of a light-weight plastic material and has a set of ears that can be placed over the lamp shade rungs. These ears are preferably provided with a hole through which a plastic tie may be used for securing the respective ears to the lampshade rung. The dome part of the structure sits over the finial preventing theft of the finial.

The dome structure of the present invention in one embodiment thereof is for protecting a finial on a lamp structure. The dome structure comprises a plastic dome with at least two spacedly disposed ears that extend from the outer periphery of the dome, in combination with at least one securing tie for securing the ear to a rung of the lamp shade structure.

Other aspects of the present invention include the ears are oppositely disposed; each ear has a hole therein for receiving a respective securing tie; each securing tie is a wire tie that may be secured by twisting the tie; in combination with the lamp structure that includes a lamp base and a lamp shade; the lamp shade also has a plurality of support rungs and the wire tie extends over one of the support rungs; the dome structure is partially spherical in shape so as to fit over the finial; there are at least three ears each having a hole therein.

In a preferred embodiment of the present invention there is provided a dome structure for protecting a finial on a lamp structure. The dome structure comprises a centrally disposed plastic dome with integrally formed legs extending in opposed directions from the dome, the dome forming an enclosing chamber that fits over the finial to prevent theft of the finial. The legs have respective interlocking elements that engage with the lamp structure.

In accordance with still other aspects of the present invention the interlocking elements retain the dome structure about the finial and lamp structure; the interlocking elements include a series of teeth on one of the legs, and at least one slot in the other leg; the other leg has at least two slots; the two slots are disposed apart so as to provide different interlock spacings; the teeth are in a saw tooth arrangement; each tooth is defined by a first straight edge that extends substantially orthogonal to the longitudinal axis of the dome structure and a second straight edge that is contiguous with the first straight edge but is disposed angularly to the longitudinal axis; the second straight edge is at an angel on the order of 30 degrees.

In still another version of the present invention there is in combination, a dome structure for protecting a finial on a lamp structure and a lamp structure for carrying the finial and including a lamp shade member. The dome structure comprises a centrally disposed plastic dome with integrally formed legs extending in opposed directions from the dome, the dome forming an enclosing chamber that fits over the finial to prevent theft of the finial. The legs have respective interlocking elements that engage with the lamp shade member.

In other aspects of the present invention the lamp shade member includes support rungs and the respective interlocking elements are constructed and arranged to wrap around at least one support rung; the interlocking elements include a series of teeth on one of the legs, and at least one slot in the other leg; the other leg has at least two slots, wherein the two slots are disposed apart so as to provide different interlock spacings, wherein the teeth are in a saw tooth arrangement and wherein each tooth is defined by a first straight edge that extends substantially orthogonal to the longitudinal axis of the dome structure and a second straight edge that is contiguous with the first straight edge but is disposed angularly to the longitudinal axis.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

Figure 1:
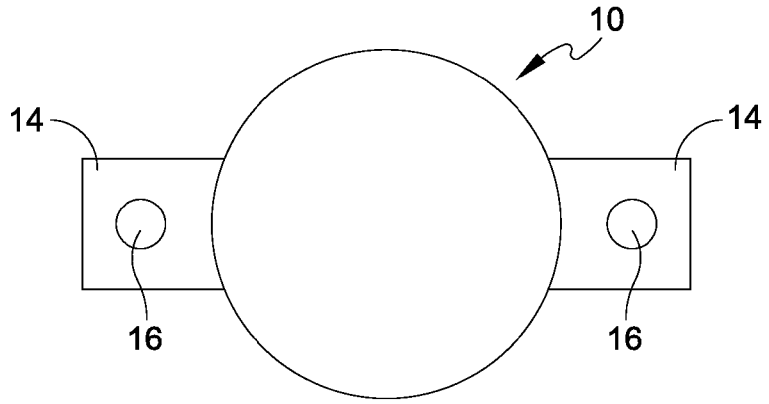
FIG. 1 is a top view of one embodiment of the protective dome of the present invention.
Figure 2:
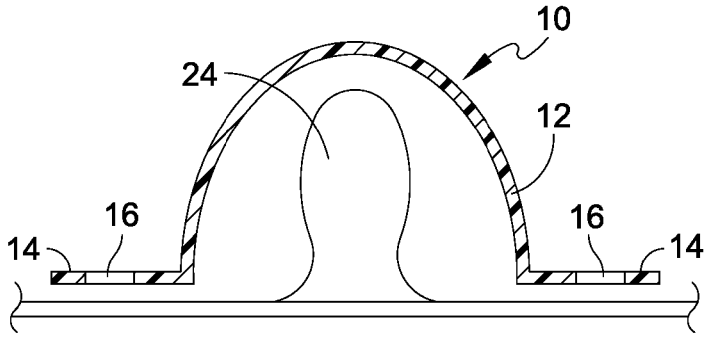
FIG. 2 is a side cross-sectional view of the protective dome of FIG. 1 also illustrating its placement over the finial.
Figure 3:
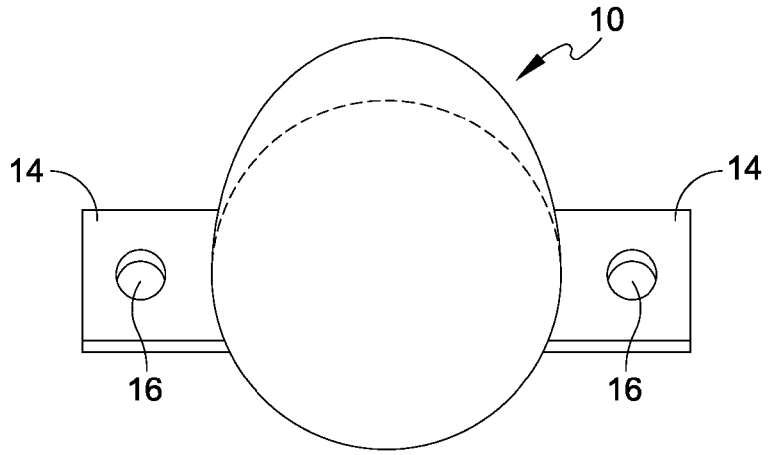
FIG. 3 is a perspective view of the dome structure illustrated in FIGS. 1 and 2.

Reference is now made to the drawings for an illustration of different embodiments of the protective dome of the present invention. This is meant for use to prevent theft of the finial on a lamp shade structure. The dome structure of the present invention is preferably of a lightweight clear plastic material that is relatively thin but is sufficiently rigid so that it cannot easily be removed from the lamp shade structure. This is illustrated in the drawings by the protective dome 10. At the base 12 of the dome 10 there is provided a pair of oppositely disposed ears 14 that are used for securing the dome structure over the lamp shade rung structure shown generally in FIG. 4 at 20. This may include a plurality of rungs 20 emanating radially from a center post 22 where the finial 24 is usually threadedly supported. The cross-sectional view of FIG. 2 illustrates the dome structure at 10 disposed over the finial 24.

Figure 4:
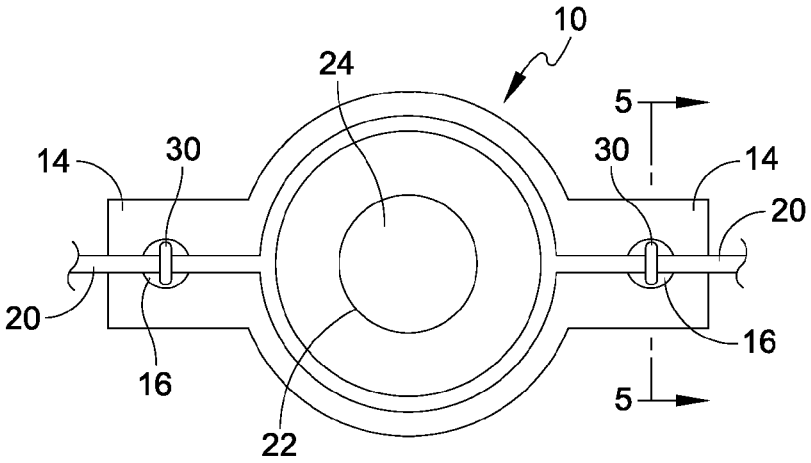
FIG. 4 schematically illustrates the dome structure as placed over the lamp shade rungs.
Figure 5:
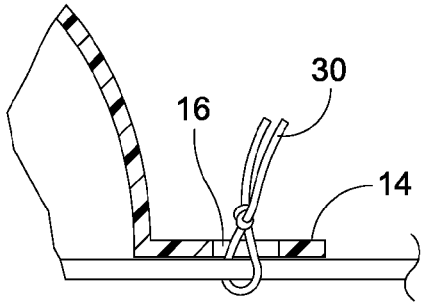
FIG. 5 is a cross-sectional view taken along line 5-5 of FIG. 4 and illustrating the use of a plastic tie for securing the protective dome to the lamp shade rung.

The ears 14 are each provided with holes 16. FIG. 4 shows the dome structure supported with the holes 16 disposed over the respective rungs 20. Next, a plastic tie 30 is used. This is secured through the hole 16 and about the rung 20 for securing the dome structure on either side thereof to the respective rungs 20. Preferably a tie 30 is used with each hole 16.

Figure 6:
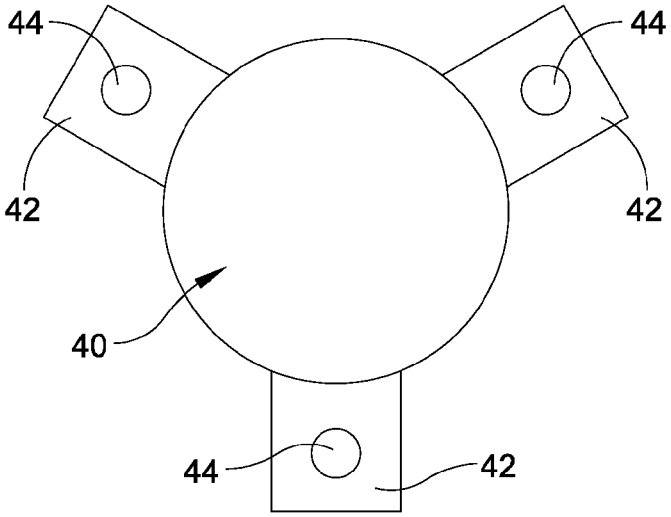
FIG. 6 illustrates an alternate embodiment of the dome protector.

An alternate embodiment of the present invention is illustrated in FIG. 6. This also shows a dome structure 40 but instead of oppositely disposed ears 14, there are illustrated three ears 42 each with a hole 44 therein. Again, plastic ties may be used for securing each of these ears to lamp rungs. In the embodiment of FIG. 6, the ears are disposed spaced apart by 120 degrees each.

Figure 7:
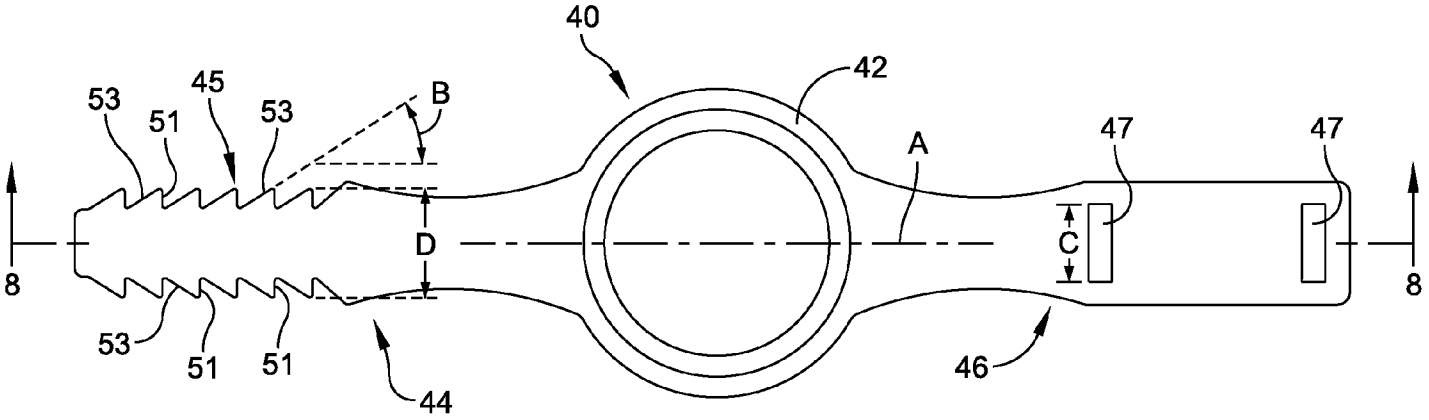
FIG. 7 is a plan view of a preferred embodiment of a dome or cover protector.
Figure 8:
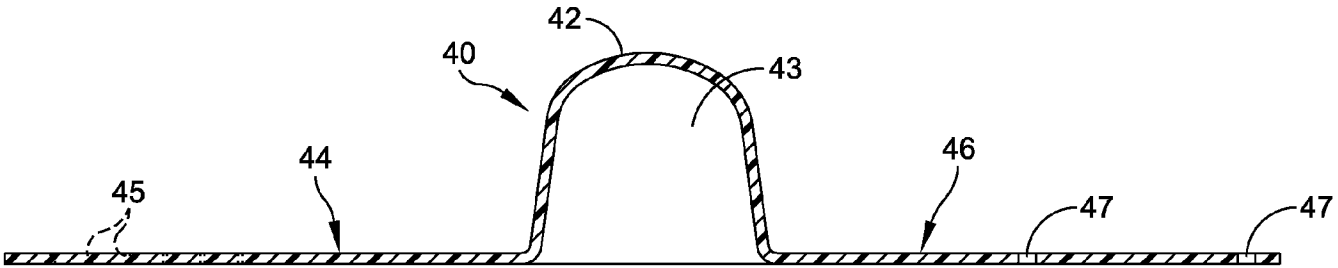
FIG. 8 is a cross-sectional view taken along line 8-8 of FIG. 7 and illustrating the dome arrangement.
Figure 9:
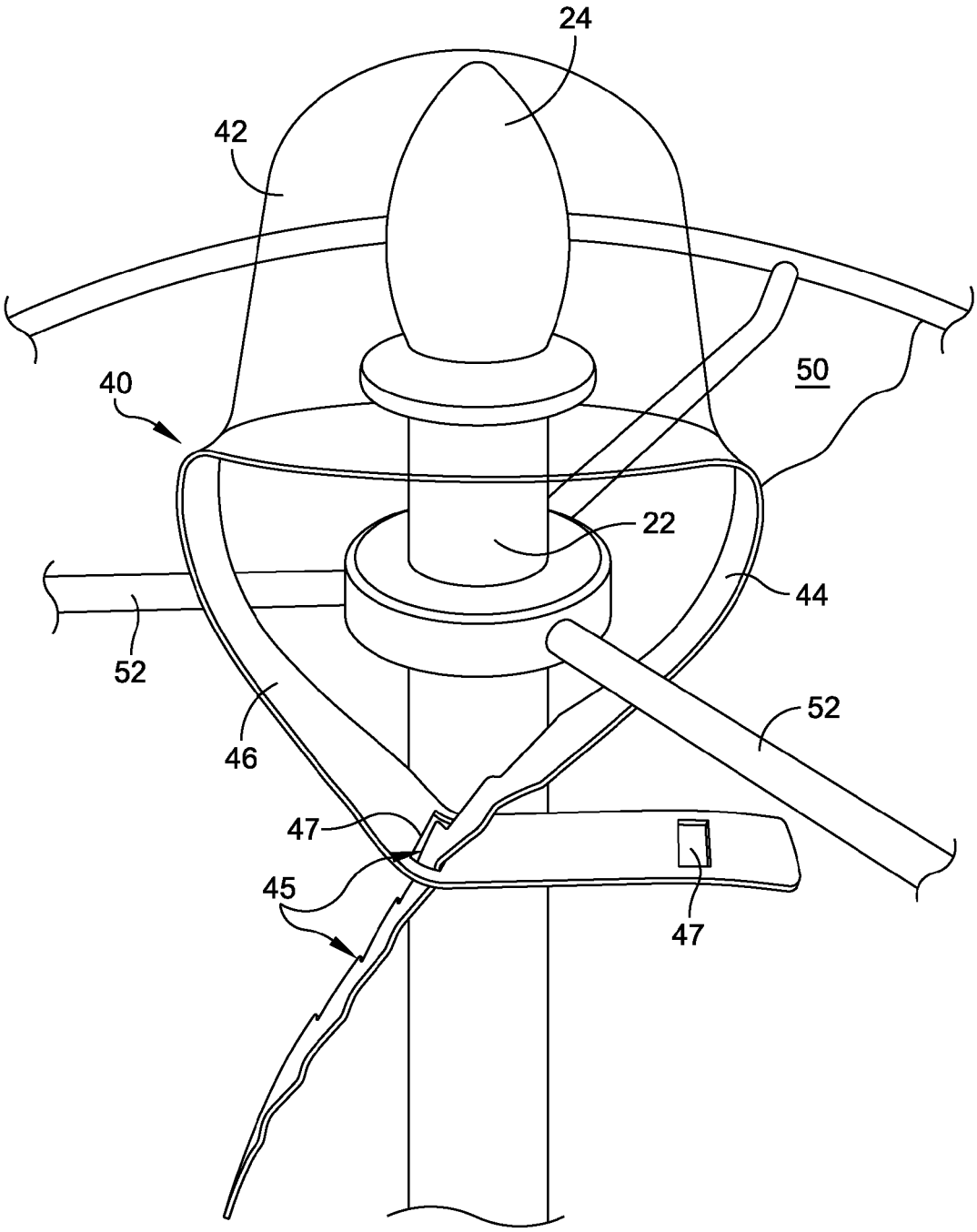
FIG. 9 is a perspective view illustrating the protector cover of the present invention as secured about a lamp structure and in particular, about the finial.

Reference is now made to a preferred embodiment of the present invention illustrated in FIGS. 7-9. FIG. 7 is a plan view of a preferred embodiment of a dome or cover protector. FIG. 8 is a cross-sectional view taken along line 8-8 of FIG. 7 and illustrating the dome arrangement. FIG. 9 is a perspective view illustrating the protector cover of the present invention as secured about a lamp structure and in particular, about the finial.

Referring now to FIG. 9, the dome or cover structure or protector is illustrated as secured about the finial 24. The dome structure 40 is comprised basically of a centrally disposed plastic dome 42 and integrally formed legs 44 and 46. FIG. 9 also illustrates the lamp shade at 50 and also illustrates the typical support rungs 52. The dome 42 forms an enclosing chamber 43 that fits over the finial to prevent theft of the finial 24. The perspective view of FIG. 9 illustrates the legs 46 engaged in interlocked about one of the rungs 52. This interlock arrangement makes it difficult for a casual observer to remove the finial. However, the interlock arrangement has sufficient flexibility so that it can be released by the store owner but cannot be easily released by the casual shopper. Without this protective cover, one can too easily screw the finial 24 from its support post 22.

Reference is now made to FIGS. 7 and 8 for further details of the protective cover 40. As indicated previously, this cover is comprised of a centrally disposed plastic dome 42 and integrally formed legs 44 and 46. The dome 42 forms an enclosing chamber 43 that fits over the finial to prevent theft of the finial. The legs have respective interlocking elements that engage with the lamp structure and preferably with the rungs 52 as illustrated in FIG. 9. The interlocking elements retain the dome about the finial and lamp structure.

One of the interlocking elements comprises a series of teeth 45 that are disposed more toward the distal end of the leg 44. The other leg 46 has corresponding interlock elements in the form of at least one slot. In the embodiment illustrated herein, there are a pair of spacedly disposed slots 47. The longitudinal axis of each of these slots extends transverse to the longitudinal axis A of the cover. These slots 47 are preferably also disposed toward the distal free end of the leg 46.

As illustrated clearly in FIG. 7, the teeth are arranged in a sawtooth pattern. Each tooth is defined by a first straight edge 51 that extends substantially orthogonal to the longitudinal axis A of the cover. Moreover, the same tooth is also defined by a second straight edge 53 that is contiguous with the first straight edge but is disposed angularly with respect to the longitudinal axis A. This angular position is illustrated by the angle B in FIG. 7 that may be on the order of 30 degrees.

The dome structure of the present invention is constructed of a relatively lightweight plastic material and is relatively thin in construction. The plastic material is somewhat pliable. In accordance with one aspect of the present invention, it is preferred that the sawtooth arrangement be provided so that the maximum dimension D illustrated in FIG. 7 is on the order of the same dimension C which is the length of the slots 47. Preferably, the dimension D is slightly greater than the dimension C so that once the sawtooth arrangement interlocks with the slot 47, the two legs cannot be easily disengaged from each other. The sawtooth pattern can easily be forced through the slot C and once at the proper position, such as illustrated in FIG. 9, the dome structure is effectively secured about the finial.

Having now described a limited number of embodiments of the present invention, numerous other embodiments and modifications thereof are now contemplated as falling within the scope of the present invention.

What is claimed is:

1. A dome structure for protecting a finial on a lamp structure, said dome structure comprising a plastic dome with at least two spacedly disposed ears that extend from the outer periphery of the dome, in combination with at least one securing tie for securing the ear to a rung of the lamp structure.

2. The dome structure of claim 1 wherein the ears are oppositely disposed.

3. The dome structure of claim 2 wherein each ear has a hole therein for receiving a respective securing tie.

4. The dome structure of claim 3 wherein each securing tie is a wire tie that may be secured by twisting the tie.

5. The dome structure of claim 4 in combination with the lamp structure that includes a lamp base and a lamp shade.

6. The dome structure of claim 5 wherein the lamp shade also has a plurality of support rungs and the wire tie extends over one of the support rungs.

7. The dome structure of claim 6 wherein the dome structure is partially spherical in shape so as to fit over the finial.

8. The dome structure of claim 1 wherein there are at least three ears each having a hole therein.

9. A dome structure for protecting a finial on a lamp structure, said dome structure comprising a centrally disposed plastic dome with integrally formed legs extending in opposed directions from the dome, the dome forming an enclosing chamber that fits over the finial to prevent theft of the finial, said legs having respective interlocking elements that engage with the lamp structure.

10. The dome structure of claim 9 wherein the interlocking elements retain the dome structure about the finial and lamp structure.

11. The dome structure of claim 10 wherein the interlocking elements include a series of teeth on one of the legs, and at least one slot in the other leg.

12. The dome structure of claim 11 wherein the other leg has at least two slots.

13. The dome structure of claim 12 wherein the two slots are disposed apart so as to provide different interlock spacings.

14. The dome structure of claim 11 wherein the teeth are in a saw tooth arrangement.

15. The dome structure of claim 14 wherein each tooth is defined by a first straight edge that extends substantially orthogonal to the longitudinal axis of the dome structure and a second straight edge that is contiguous with the first straight edge but is disposed angularly to the longitudinal axis.

16. The dome structure of claim 15 wherein the second straight edge is at an angel on the order of 30 degrees.

17. In combination, a dome structure for protecting a finial on a lamp structure and a lamp structure for carrying the finial and including a lamp shade member, said dome structure comprising a centrally disposed plastic dome with integrally formed legs extending in opposed directions from the dome, the dome forming an enclosing chamber that fits over the finial to prevent theft of the finial, said legs having respective interlocking elements that engage with the lamp shade member.

18. The combination of claim 17 wherein the lamp shade member includes support rungs and the respective interlocking elements are constructed and arranged to wrap around at least one support rung.

19. The combination of claim 18 wherein the interlocking elements include a series of teeth on one of the legs, and at least one slot in the other leg.

20. The combination of claim 19 wherein the other leg has at least two slots, wherein the two slots are disposed apart so as to provide different interlock spacings, wherein the teeth are in a saw tooth arrangement and wherein each tooth is defined by a first straight edge that extends substantially orthogonal to the longitudinal axis of the dome structure and a second straight edge that is contiguous with the first straight edge but is disposed angularly to the longitudinal axis.

* * * * *